US010151515B2

(12) United States Patent
Chen et al.

(10) Patent No.: US 10,151,515 B2
(45) Date of Patent: Dec. 11, 2018

(54) VORTEX TUBE COOLER

(71) Applicant: Arizona Board of Regents on behalf of Arizona State University, Scottsdale, AZ (US)

(72) Inventors: Kangping Chen, Scottsdale, AZ (US); Ruijin Chen, Tempe, AZ (US)

(73) Assignee: ARIZONA BOARD OF REGENTS ON BEHALF OF ARIZONA STATE UNIVERSITY, Scottsdale, AZ (US)

( * ) Notice: Subject to any disclaimer, the term of this patent is extended or adjusted under 35 U.S.C. 154(b) by 183 days.

(21) Appl. No.: 14/917,627

(22) PCT Filed: Nov. 18, 2014

(86) PCT No.: PCT/US2014/066116
§ 371 (c)(1),
(2) Date: Mar. 9, 2016

(87) PCT Pub. No.: WO2015/077217
PCT Pub. Date: May 28, 2015

(65) Prior Publication Data

US 2016/0216009 A1 Jul. 28, 2016

Related U.S. Application Data

(60) Provisional application No. 61/906,243, filed on Nov. 19, 2013.

(51) Int. Cl.
*F25B 9/02* (2006.01)
*F25B 9/04* (2006.01)
(Continued)

(52) U.S. Cl.
CPC ..... *F25B 9/04* (2013.01); *E21B 21/16* (2013.01); *E21B 36/001* (2013.01); *F25B 9/004* (2013.01)

(58) Field of Classification Search
CPC ..... F25B 9/04; F25B 9/02; B04C 2003/003; B04C 3/06; B04C 5/02; B04C 5/06; B04C 5/08; B04C 5/081
(Continued)

(56) References Cited

U.S. PATENT DOCUMENTS 2,861,780 A 11/1958 Butler
3,173,273 A * 3/1965 Fulton ..... C03B 27/0404 285/332.3
(Continued)

OTHER PUBLICATIONS

International Search Report from Parent PCT/US2014/066116, dated Apr. 28, 2015, 2 pages.
Cang, R. "Optimized Vortex Tube Bundle for Large Flow Rate Applications", PhD thesis, Arizona State University, Tempe, Arizona, May 2013.
(Continued)

*Primary Examiner* — Joseph Trpisovsky
(74) *Attorney, Agent, or Firm* — Quarles & Brady LLP

(57) ABSTRACT

A vortex tube cooling system for cooling compressed gas in air drilling assemblies comprises a gas source, a compressor, a plurality of vortex tube coolers and a drilling pipe in fluid communication with the plurality of vortex tube coolers. Each vortex tube cooler has an inlet nozzle for receiving compressed gas from the gas source into a swirl chamber. The swirl chamber is in fluid connection with a vortex tube defining a hot outlet, and a cold outlet. An inlet of the drilling pipe receives a cold air stream leaving the cold outlet of the plurality of vortex tube coolers.

4 Claims, 3 Drawing Sheets

(51) Int. Cl.
*E21B 21/16* (2006.01)
*E21B 36/00* (2006.01)
*F25B 9/00* (2006.01)

(58) Field of Classification Search
USPC ..... 62/5
See application file for complete search history.

(56) References Cited

U.S. PATENT DOCUMENTS

| | | | | |
|---|---|---|---|---|
| 4,287,957 | A | 9/1981 | Evans | |
| 7,263,836 | B2 | 9/2007 | Gunawardana et al. | |
| 7,685,819 | B2 * | 3/2010 | Vetrovec | F02B 29/0412 123/540 |
| 2005/0025753 | A1 | 11/2005 | Gunawardana et al. | |
| 2005/0257533 | A1 | 11/2005 | Gunawardana et al. | |
| 2010/0175869 | A1 * | 7/2010 | Cobb | B04C 5/081 166/105.1 |
| 2011/0012067 | A1 | 5/2011 | Oh et al. | |
| 2011/0120677 | A1 | 5/2011 | Oh et al. | |
| 2011/0252815 | A1 * | 10/2011 | Bakos | F25B 9/04 62/5 |
| 2012/0007023 | A1 | 3/2012 | Allehaux et al. | |
| 2012/0070237 | A1 | 3/2012 | Allehaux et al. | |
| 2013/0003187 | A1 | 2/2013 | Bindas et al. | |
| 2013/0031877 | A1 | 2/2013 | Bindas et al. | |

OTHER PUBLICATIONS

International Search Report for PCT/US2014/066116, dated Apr. 28, 2015.

* cited by examiner

VORTEX TUBE COOLER

RELATED APPLICATIONS

This application is a U.S. national stage application under 35 U.S.C. § 371 of PCT Application No. PCT/US2014/066116, filed Nov. 18, 2014, published on May 28, 2015 as WO 2015/077217, which claims priority under 35 U.S.C. § 119 from U.S. Provisional Patent Application No. 61/906,243 filed on Nov. 19, 2013, each of which is incorporated herein by reference in its entirety.

BACKGROUND

The invention relates generally to a vortex tube used to provide cooling for air or gas drilling operations.

A vortex tube is a mechanical device that can be used to separate gas streams into a hot stream and a cold stream. The separation of the hot stream from the cold stream is accomplished by first expanding the gas stream at the inlet of the vortex tube. Then the gas stream then enters a swirl chamber with a high tangential velocity and is forced to travel towards a hot end of the vortex tube. When traveling towards the hot end of the vortex tube, the gas stream is separated into an outer hot stream and an inner cold stream. Lastly, a valve placed at the hot end of the vortex tube directs the hot stream and the cold stream.

Vortex tubes are characterized as either a downstream type or a counter flow type. In the downstream type, the valve allows both the hot stream and the cold stream to exit out the hot end of the vortex tube. Alternatively, in the counter flow type, the valve directs the cold stream in the opposite direction where it exits the vortex tube out of a cold end and directs the hot stream to exit out of the hot end of the vortex tube.

The use of air or gas streams as circulating mediums for drilling operations in recovery wells, including oil, natural gas, and geothermal fluids wells, has become a widely accepted and effective technique in recovery operations. In some instances, "air drilling" or "gas drilling" with compressed air or nitrogen is a preferred approach over conventional heavy drilling fluids, which are used, for instance, in drilling oil wells.

Heavy drilling fluids are used to cool drilling bits and bring broken rock cuttings up to the surface of the well. However, in addition to being expensive, the heavy drilling fluids exert high pressure on the rocks, which reduces drilling rates. For shallow and dry formations of the well, air drilling or gas drilling is a more economical approach that can speed up the drilling process considerably.

Commonly, the compressed air or gas is pumped into a drilling string of a drilling rig and utilized directly in the drilling process. In such operations, however, high amounts of heat are generated at the drilling bits deployed within the well. The drilling bits and other equipment exposed within the well tend to deteriorate under the high heat stress by cracking and burning over time. When such drilling tools deteriorate, they require replacements, which can be frequent and result in costly idling time.

Therefore, it would be desirable to have a vortex tube capable of providing adequate cooling to an air or gas drilling operation. Furthermore, it would be desirable to have a cooling system comprising a plurality of vortex tubes capable of meeting high flow capacity demands present in air or gas drilling operations.

BRIEF SUMMARY OF THE INVENTION

A vortex tube cooler and a vortex tube cooling system are disclosed that address the aforementioned problems. In one aspect, the invention provides a vortex tube cooler may include an inlet nozzle, a swirl chamber arranged to receive a flow of compressed gas from the inlet nozzle, a vortex tube in fluid communication with the swirl chamber and defining a vortex tube diameter D, a vortex tube length L, and a hot outlet arranged at an opposite end of the vortex tube from the swirl chamber, and a vortex ratio of the vortex tube length to the vortex tube diameter L/D is between about ten and eighteen.

In another aspect, the invention provides a vortex tube cooling system for cooling gas in gas drilling assemblies. The vortex tube cooling system includes a gas source, a compressor arranged to receive gas from the gas source and generate high pressure compressed gas at a vortex tube cooler inlet pressure $P_I$, a plurality of vortex tube coolers, and a drilling pipe in fluid communication with the plurality of vortex tube coolers.

In some embodiments, each vortex tube cooler in the plurality of vortex tube coolers include an inlet nozzle for receiving the high pressure compressed gas into a swirl chamber, a vortex tube in fluid communication with the swirl chamber and defining a vortex tube diameter D, a vortex tube length L, and a hot outlet arranged at an opposite end of the vortex tube from the swirl chamber, and a cold outlet arranged at an opposite end of the vortex tube cooler from the hot outlet and including a cold outlet aperture and a cold exit.

In still other embodiments, an inlet of the drilling pipe receives a cold compressed gas flow leaving the plurality of vortex tube coolers at a vortex tube cold outlet pressure $P_C$.

The foregoing and other aspects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims and herein for interpreting the scope of the invention.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

DETAILED DESCRIPTION OF THE INVENTION

Figure 1:
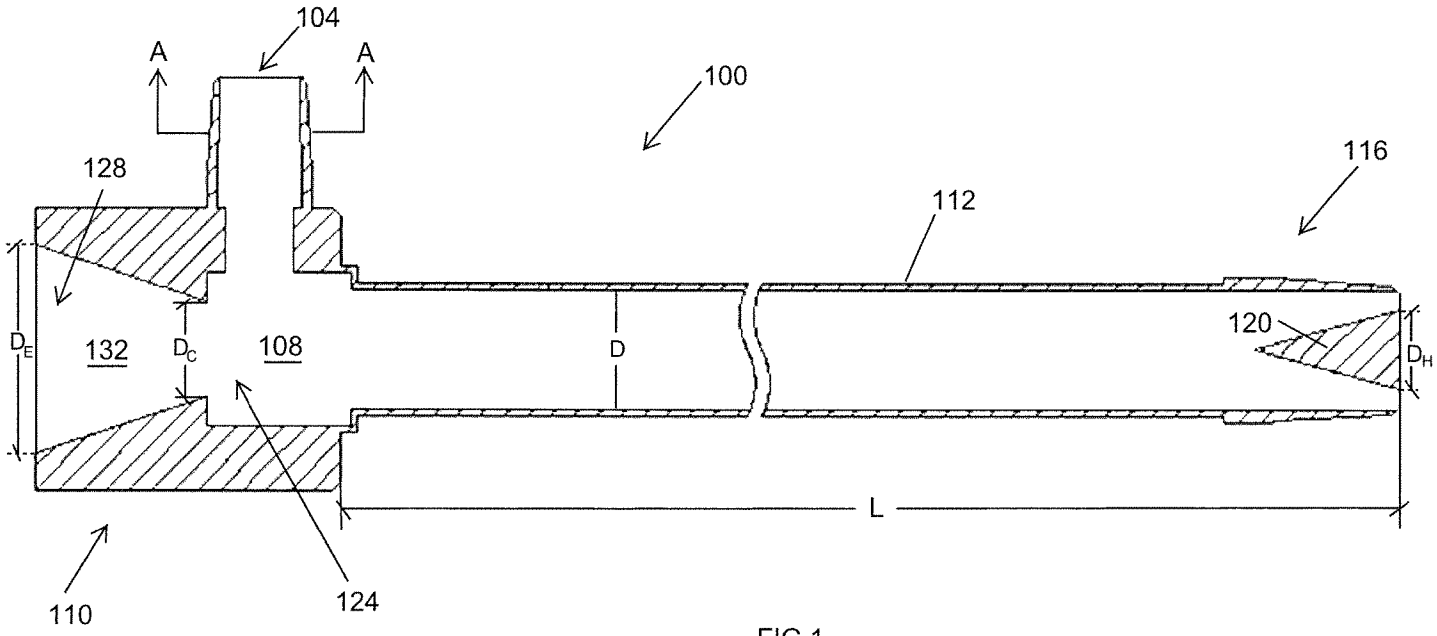
FIG. 1 is a cross-section view of a vortex tube cooler according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 shows a vortex tube cooler 100 including an inlet nozzle 104, a swirl chamber 108, a cold outlet 110, and a vortex tube 112 defining a hot outlet 116. The inlet nozzle 104 is arranged generally transverse to the vortex tube 112 and is fluidly connected to the vortex tube 112 through the swirl chamber 108. The inlet nozzle 104, the swirl chamber 108, the cold outlet 110, and the vortex tube 112 are integrally formed in the illustrated embodiment.

Figure 2:
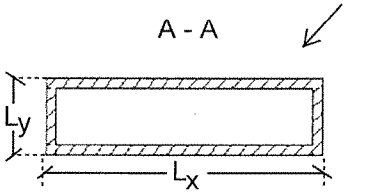
FIG. 2 is a cross-section view of an inlet nozzle of the vortex tube cooler taken along line A-A of FIG. 1.

As shown in FIG. 2, the inlet nozzle 104 defines a substantially rectangular shape. The inlet nozzle 104 further defines an aspect ratio $L_X/L_Y$, a ratio of a longitudinal length $L_X$ of the inlet nozzle 104 to a latitudinal length $L_Y$ of the inlet nozzle 104, of approximately 0.2 in the illustrated embodiment. In other embodiments, the inlet nozzle $L_X/L_Y$ aspect ratio may between about 0.1 and 0.3.

With reference back to FIG. 1, the vortex tube 112 is in fluid communication with the swirl chamber 108, and further defines a vortex tube length L, a vortex tube diameter D, and a vortex ratio L/D. The vortex ratio L/D can be defined as the ratio of the vortex tube length L divided by the vortex tube diameter D. In the illustrated embodiment, the vortex tube length L is approximately 789 millimeters, and the vortex ratio L/D is approximately fourteen. In other embodiments, the vortex tube length L and the vortex tube diameter D may be constrained by a different vortex ratio L/D, as desired. For example, the vortex ratio L/D could be between about ten and eighteen.

The hot outlet 116 is arranged at an opposite end of the vortex tube 112 from the swirl chamber 108 and includes a conical valve 120. The conical valve 120 is attached to a support structure (not shown) that threadingly engages the hot outlet 116 but does not seal the hot outlet 116 from the surroundings. The hot outlet 116 defines a hot outlet valve diameter $D_H$ which is less than the vortex tube diameter D; therefore, fluid is allowed to flow around the conical valve 120 and exit the hot outlet 116. In the illustrated embodiment, the hot outlet valve diameter $D_H$ is approximately 25 millimeters.

With continued reference to FIG. 1, the cold outlet 110 includes a cold outlet aperture 124 and a cold exit 128, and defines a expansion zone 132 between the cold outlet aperture 124 and the cold exit 128. The cold outlet 110 is in fluid communication with the swirl chamber 108 and is arranged on an opposite end of the vortex tube cooler 100 from the hot outlet 116. The cold outlet aperture 124 defines a cold outlet diameter $D_C$ which is approximately 14.25 millimeters in the illustrated embodiment. In other embodiments, the cold outlet diameter may be sized differently to accommodate other applications, as desired. A cold outlet ratio $D/D_C$ may be defined as a ratio of the cold outlet diameter $D_C$ to the vortex tube diameter D. In the illustrated embodiment, the cold outlet ratio $D/D_C$ is approximately 0.5. In other embodiments, the cold outlet ratio $D/D_C$ may be between 0.4 and 0.6.

The expansion zone defines a cold zone expansion ratio $D_E/D_C$. The cold zone expansion ratio $D_E/D_C$ may be defined as the ratio of a cold exit diameter $D_E$ to the cold outlet diameter $D_C$. In the illustrated embodiment, the cold zone expansion ratio $D_E/D_C$ is greater than about one.

In operation, a compressed gas stream (not shown) enters the inlet nozzle 104 of the vortex tube cooler 100 at an inlet pressure $P_I$ where the flow is accelerated and directed towards the swirl chamber 108. The compressed gas stream enters the swirl chamber 108 with a high tangential velocity and travels toward the hot outlet 116 of the vortex tube 112. When flowing towards the hot outlet 116, the compressed gas stream separates into an outer hot gas stream (not shown) and an inner cold gas stream (not shown) surrounded by the hot gas stream.

The conical valve 120 in the hot outlet 116 of the vortex tube 112 directs the cold gas stream backwards towards the cold outlet 110, while the hot gas stream is allowed to flow around the conical valve 120 and exit the hot outlet 116. The cold gas stream travels through the cold outlet aperture 124 of the cold outlet 110 and is then expanded through the expansion section 132. Finally, the cold gas stream exits the vortex tube cooler 100 through the cold exit 128 at a cold outlet pressure $P_C$. An expansion ratio $P_I/P_C$ may be defined as the ratio of the inlet pressure $P_I$ to the cold outlet pressure $P_C$. In the illustrated embodiment, the expansion ratio is approximately 3.2. In other embodiments, the expansion ratio may be between approximately 3.0 and 3.4.

Figure 3:
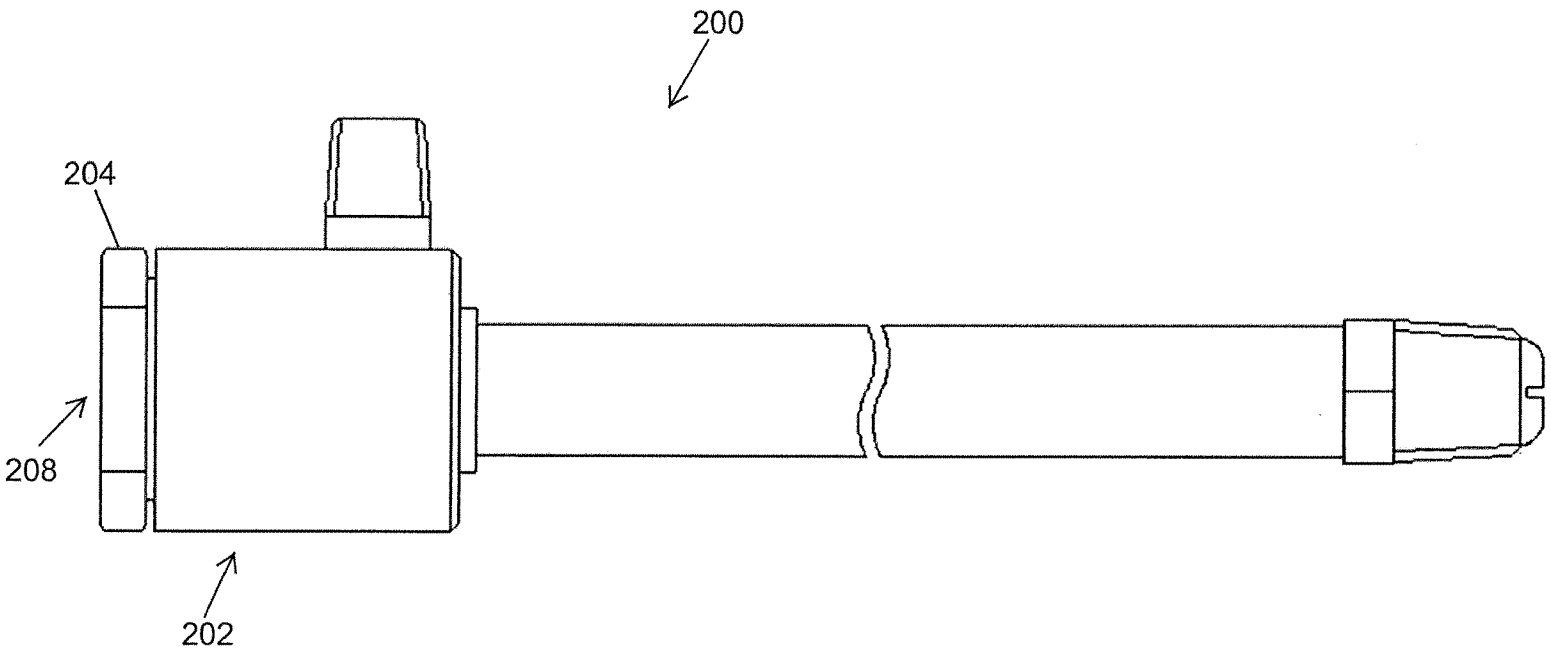
FIG. 3 is a side view of a vortex tube cooler according to another embodiment of the current invention.

FIG. 3 shows a vortex tube cooler 200 with all of the same elements as the vortex tube 100, as described above with reference to FIGS. 1 and 2, except a cold outlet 202 of the vortex tube cooler 200 includes an end cap 204 that defines a cold exit 208 and a cold exit diameter (not shown). The end cap 204 may include a vortex generator (not shown) to aid in the generation of a swirling flow within the swirl chamber. The end cap 204 threadingly engages a threaded inner surface of the swirl chamber. The vortex tube 200 further includes all of the same dimension and dimensional ratios as vortex tube 100, as described above with reference to FIGS. 1 and 2.

Figure 4:
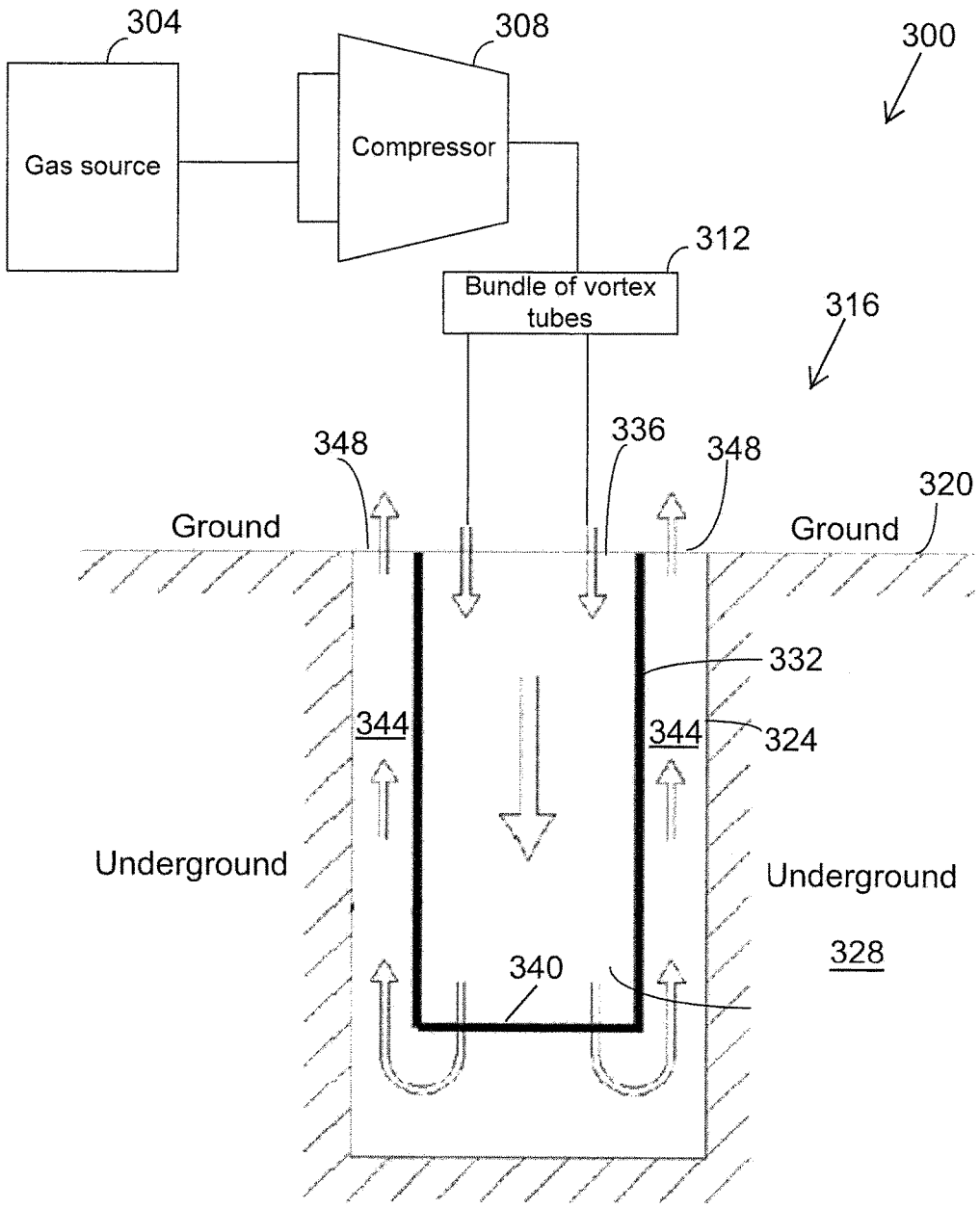
FIG. 4 is a schematic of a vortex tube cooling system according to one embodiment of the current invention.

FIG. 4 show a vortex tube cooling system 300 for cooling compressed gas in gas drilling assemblies including a gas source 304, a compressor 308, and a bundle of vortex tube coolers 312. The bundle of vortex tube coolers 312 includes a plurality of either the vortex tube cooler 100 or the vortex tube cooler 200, described above. In the illustrated embodiment, the bundle of vortex tube coolers 312 includes approximately sixteen vortex tube coolers 100. In another embodiment, the bundle of vortex tube coolers 312 includes between approximately fifteen and twenty vortex tube coolers 100.

The vortex tube cooling system 300 is used to cool a drilling location 316 including a surface 320, typically at ground level, and a wellbore 324 extending through an underground layer 328. A drilling pipe 332 extends through the wellbore 324 and defines an inlet 336 near the surface 320 and a drilling head 340 arranged on the opposite side of the wellbore 324 from the inlet 336. The drilling head 340 may include a drilling bit or other means for cutting through the underground layer 328.

In operation, the gas source 304 provides gas to the compressor 308 where high pressure compressed gas at a vortex tube cooler inlet pressure $P_I$ is generated. The compressed gas then flows through the bundle of vortex tube coolers 312 where the compressed gas is cooled and exits at a vortex tube cooler cold outlet pressure $P_C$. An expansion ratio $P_I/P_C$ may be defined as the ratio of the vortex tube cooler inlet pressure $P_I$ to the vortex tube cooler cold outlet pressure $P_C$. In the illustrated embodiment, the expansion ratio is approximately 3.2. In other embodiments, the expansion ratio may be between approximately 3.0 and 3.4.

The cooled compressed gas enters the drilling location 316 at the inlet 336 of the drilling pipe 332 and is guided underground through the drilling pipe 332. The cooled compressed gas flows through the drilling head 340 where heat is transferred from the drilling head 340 to the cooled compressed gas, warming the gas and cooling the drilling head 340. The warmed compressed gas travels upwardly toward the surface 320 in a channel 344 surrounding the drilling pipe 332, where is eventually exits the wellbore 324 at a surface outlet 348 arranged on the surface 320 surrounding the drilling pipe 332.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

We claim:

1. A vortex tube cooling system for cooling compressed gas in gas drilling assemblies comprising:

a gas source;

a compressor arranged to receive gas from the gas source and generate high pressure compressed gas at a vortex tube cooler inlet pressure $P_I$;

a plurality of vortex tube coolers, wherein each vortex tube cooler includes an inlet nozzle for receiving the high pressure compressed gas into a swirl chamber, a vortex tube wherein the vortex tube is in fluid communication with the swirl chamber and defines a vortex tube diameter (D), a vortex tube length (L), and a hot outlet arranged at an opposite end of the vortex tube from the swirl chamber, and a cold outlet arranged on an opposite end of the vortex tube cooler from the hot outlet and including a cold outlet aperture and a cold exit, and wherein the plurality of vortex tube coolers are located above ground-level; and a drilling pipe in fluid communication with the plurality of vortex tube coolers, wherein an inlet of the drilling pipe receives a cold compressed gas flow leaving the plurality of vortex tube coolers at a vortex tube cooler cold outlet pressure $P_C$.

2. The vortex tube cooling system of claim 1, wherein the plurality of vortex tube coolers includes between approximately fifteen and twenty vortex tube coolers.

3. The vortex tube cooling system of claim 1, wherein the plurality of vortex tube coolers includes approximately sixteen vortex tube coolers.

4. The vortex tube cooling system of claim 1, wherein an expansion ratio of the vortex tube cooler inlet pressure to the vortex tube cooler cold outlet pressure (PI/PC) between approximately 3.0 and 3.4.

* * * * *